US005907888A

United States Patent [19]

Oh

[11] Patent Number: 5,907,888

[45] Date of Patent: Jun. 1, 1999

[54] SUCTION NOZZLE OF VACUUM CLEANERS

[75] Inventor: Jang-Geun Oh, Kwangju, Rep. of Korea

[73] Assignee: Kwangju Electronics Co., Ltd., Kwangju, Rep. of Korea

[21] Appl. No.: 08/922,393

[22] Filed: Sep. 3, 1997

[30] Foreign Application Priority Data

Sep. 10, 1996 [KR] Rep. of Korea ..... 96-28750

[51] Int. Cl.[6] ..... A47L 9/00

[52] U.S. Cl. ..... 15/326; 15/377

[58] Field of Search ..... 15/326, 377

[56] References Cited

U.S. PATENT DOCUMENTS

Re. 21,519 7/1940 Norris ..... 15/326

3,204,282 9/1965 Groves et al. ..... 15/326

3,218,783 11/1965 Ripple ..... 15/326

5,517,716 5/1996 Park ..... 15/326

*Primary Examiner*—David A. Redding

*Attorney, Agent, or Firm*—Staas & Halsey

[57] ABSTRACT

A suction nozzle of a vacuum cleaner enables to reduce the noise produced by air friction and whirlpool in the suction flow route. A suction nozzle of a vacuum cleaner has a soft brush body provided with a front roller and a rear roller, thereby being moved by the front and rear roller, and formed the plurality of hole along a suction flow route. A brush cover is formed at an upper side of the soft brush body. A brush holder provided with a connection flow route connected with the suction flow route formed at the soft brush body through the brush cover. A noise absorbing material is formed at oppsite side of the suction flow route to closely adhere on the hole.

3 Claims, 1 Drawing Sheet

SUCTION NOZZLE OF VACUUM CLEANERS

BACKGROUND OF THE INVENTION

1. Field of the Invention

This invention relates, in general, to a vacuum cleaner, and more particularly to a suction nozzle of a vacuum cleaner which enables to reduction in the noise produced by air friction and whirlpools in the suction flow route.

2. Description of the Prior Art

Various styles of vacuum cleaners are suggested of which the general function is to suck dust and other materials by the suction force of the motor, equipped in the main body of the cleaner, to conduct the cleaning.

As illustrated in the FIG. 1, a suction nozzle 10 is connected to a suction pipe 20. The above mentioned suction nozzle 10 consists of a soft brush body 13 that is moved back and forth using a front roller 11 and rear roller 12, a brush cover 14 fixed in the top of the soft brush body 13, and a connection holder 15 with a connection flow route 151 which fits onto a suction flow route 131 which is made on the soft brush body 13 in connection with the brush cover 14.

Among these, the suction flow route 131, connection flow route 151, soft brush body 13, and connection holder 15 are made entirely of plastic.

Accordingly when power is supplied to the vacuum cleaner and the suction pressure is generated by the motor, dust and other debris are sucked through the above mentioned suction flow route 131 and connection flow route 151 and collected into a paper bag which is equipped in the main body.

During the above procedure, by moving the soft brush body 13 using the front/rear rollers 11 and 12 back and forth, large areas can be easily cleaned by the vacuum cleaner.

However, the soft brush body 13 and the connection holder 15 equipped with the suction flow route 131 and the connection flow route 151 are made entirely of plastic, thus, there is a defect in that much noise is produced by air friction and whirlpools during the cleaning.

SUMMARY OF THE INVENTION

It is, therefore, an object of the invention to provide a suction nozzle of vacuum cleaner which enables reducing the noise produced by air friction and whirlpools in the suction flow route.

In order to accomplish the above object, there is provided a suction nozzle of a vacuum cleaner comprising:

- a soft brush body provided with a front roller and a rear roller, thereby being moved by the front and rear roller, formed with a plurality of holes along a suction flow route;
- a brush cover formed at an upper side of the soft brush body;
- a brush holder provided with a connection flow route connected with the suction flow route formed at the soft brush body through the brush cover; and
- a noise absorbing material formed at oppsite side of the suction flow route to closely adhere on the holes.

BRIEF DESCRIPTION OF THE DRAWINGS

For fuller understanding of the nature and object of the invention, reference should be made to the following detailed description taken in conjunction with the accompanying drawings in which.

DETAILED DESCRIPTION OF THE PREFERRED EMBODIMENTS

The invention will now be described in detail with reference to the accompanying drawings.

Figure 1:
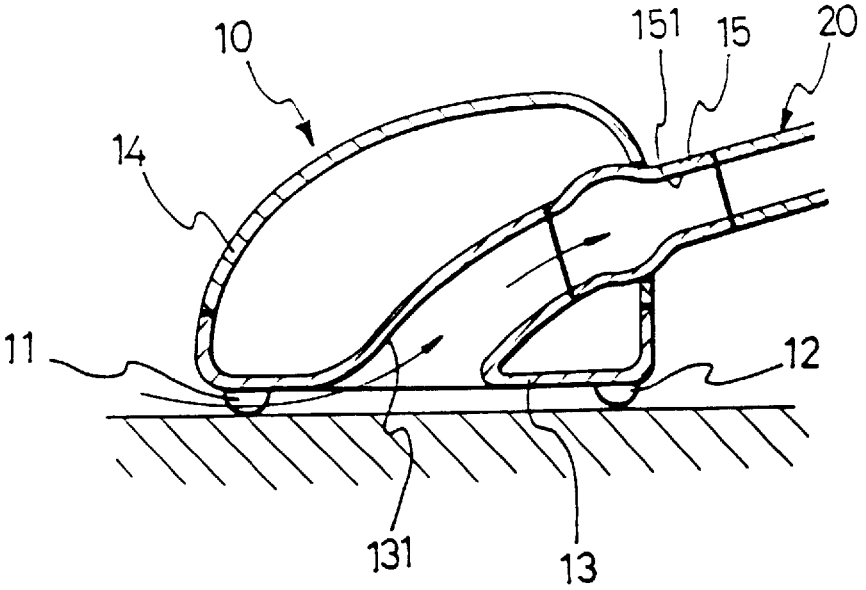
FIG. 1 is a cross sectional view of a typical suction nozzle of a vacuum cleaner.
Figure 2:
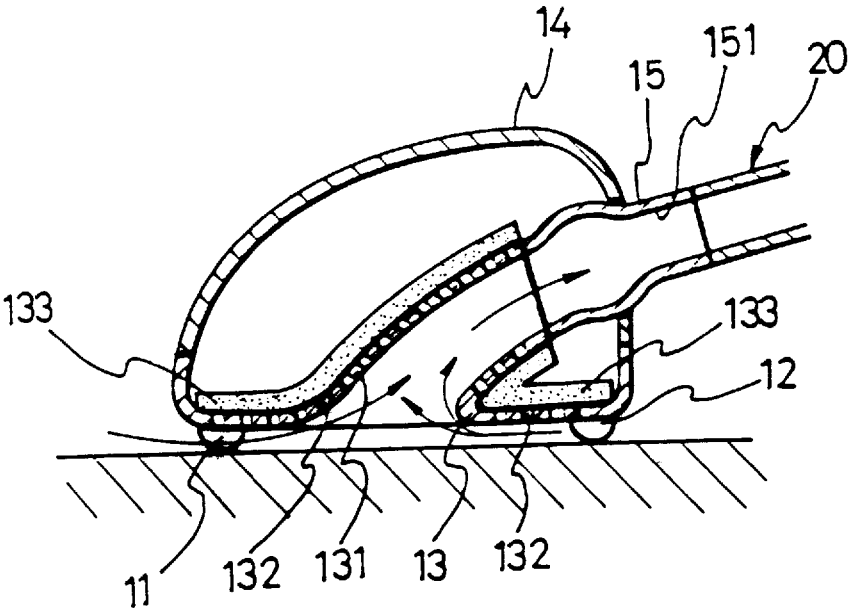
FIG. 2 is a cross sectional view of a suction nozzle of a vacuum cleaner of the present invention.
Figure 3:
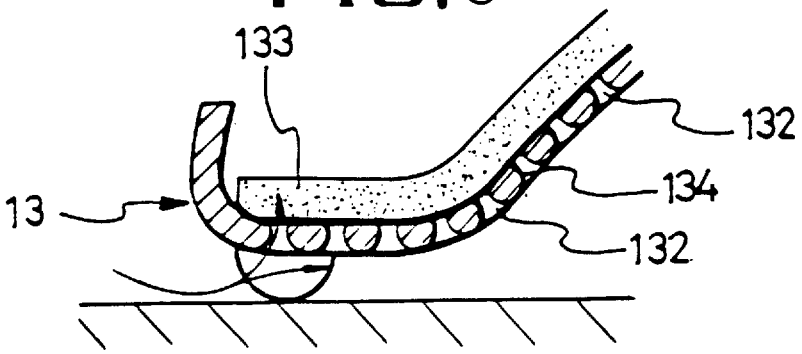
FIG. 3 is a partially sectional view of a bottom part of the suction nozzle of the present invention.

FIG. 2 is a cross sectional view of a suction nozzle of a vacuum cleaner of the present invention and FIG. 3 is a partially sectional view of a bottom part of the suction nozzle of the present invention. The same numbers correspond to the same parts compared with the FIG. 1.

A suction nozzle consists of a soft brush body 13 movable back and forth with a front roller 11 and rear roller 12, a brush cover 14 fixed on the top of the soft brush body 13, and the brush holder with a connection flow route 151 which fits with a suction flow route 131 which is made on the soft brush body 13 in connection with the brush cover 14; the inside structure is unique in that many holes 132 are made on and along the suction flow route 131 of the soft brush body 13, a part of the suction nozzle, and a noise absorbing material 133 is closely attached above the holes 132 on the opposite side of the suction flow route 131.

In the above device, the edge of the lower part of the hole 132 is made to form an arc to reduce the noise occurred by the air friction and whirlpools, it is recommended that the diameter of the above mentioned hole is to be 2 mm through 3 mm.

The reaction and effect of this invention are explained below.

When the power cord of the main body of the cleaner is put into a power source, dust and other debris are sucked through the above mentioned section flow route 131 and the connection flow route 151 of the suction nozzle 10 and are collected into a paper bag and the air is ventilated through the motor. During this procedure frictional noise is reduced by the holes 132, on the soft brush body 13, and by the noise absorbing material 133 which is closely attached on the holes 132.

In addition, the formation of the above mentioned arc 134 of the lower part of the hole much reduces the amount of air or the different things which collide with the holes 132.

As explained above, in this invention, many holes 132 are made on and along the suction flow route 131 of the soft brush body 13, a part of the suction nozzle 10, and the noise absorbing materials 133 are closely attached on the above mentioned holes 132 on the opposite side of the suction flow route; this device produces an effect in which the noise generated by air friction and whirlpool, in the suction flow route of the suction nozzle, is greatly reduced.

The detailed performance of this invention is explained above, however a person possessing ordinary knowledge in this field could modify the above device and apply for various uses on the basis of the concept of the above invention.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A suction nozzle of a vacuum cleaner including a soft brush body provided with a front roller and a rear roller for forward and backward movement of said suction nozzle, a brush cover associated with an upper part of said soft brush body, a brush holder provided with a connection flow route formed through said brush cover, a suction sleeve fixed on said soft brush body, and a noise absorbing material, the suction nozzle comprising:

the connection flow route formed through said brush cover being connected with said suction sleeve;

a plurality of holes is formed on the soft brush body along a suction flow route; and the noise absorbing material is formed at an opposite side of a body wall relative to a sucked air flow and is adhered on said holes.

2. A suction nozzle of a vacuum cleaner according to claim 1, wherein the suction nozzle comprising said plurality of holes is formed between arched walls disposed at the opposite side of the body wall to reduce noise generated by air friction and whirlpools.

3. A device for minimizing noise and adapted for use with a vacuum cleaner, said device comprising:

a suction flow route formed of plastic and extending centrally through a soft brush body;

a connection flow route that fits to said suction flow route;

wherein said soft brush body contains the connection flow route and the suction flow route;

wherein a plurality of holes are located along a portion of said suction flow route; and wherein a noise absorbing material is disposed above said holes and inside of said soft brush body.

* * * * *